US006923528B2

(12) United States Patent
Shimada

(10) Patent No.: US 6,923,528 B2
(45) Date of Patent: Aug. 2, 2005

(54) LIQUID-JET HEAD AND LIQUID-JET APPARATUS

(75) Inventor: Masato Shimada, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/228,272

(22) Filed: Aug. 27, 2002

(65) Prior Publication Data

US 2003/0063165 A1 Apr. 3, 2003

(30) Foreign Application Priority Data

Aug. 28, 2001 (JP) ..... 2001-257746
Aug. 22, 2002 (JP) ..... 2002-241451

(51) Int. Cl.[7] ..... B41J 2/045
(52) U.S. Cl. ..... 347/68; 347/70; 347/71; 347/72
(58) Field of Search ..... 347/68, 70–72

(56) References Cited

U.S. PATENT DOCUMENTS 6,142,616 A * 11/2000 Akahane ..... 347/71
6,378,996 B1 * 4/2002 Shimada et al. ..... 347/70

FOREIGN PATENT DOCUMENTS

| | | | |
|---|---|---|---|
| EP | 0 963 846 A2 * | 12/1999 | B41J/2/14 |
| JP | 5-286131 | | 11/1993 |
| JP | 11-078015 | | 3/1999 |
| JP | 2000-190497 | | 7/2000 |
| JP | 2000-211134 | | 8/2000 |
| JP | 2000-326503 | | 11/2000 |
| JP | 2001-096747 | * | 4/2001 |
| JP | 2001-205815 | | 7/2001 |
| JP | 02001205815 A | * | 7/2001 |
| WO | WO 98/18632 | | 5/1998 |

* cited by examiner

*Primary Examiner*—Hai Pham
*Assistant Examiner*—Lam Nguyen
(74) *Attorney, Agent, or Firm*—Sughrue Mion, PLLC

(57) ABSTRACT

A liquid-jet head includes a passage-forming substrate having a plurality of pressure generation chambers communicating with corresponding nozzle orifices; and a plurality of piezoelectric elements provided on one side of the passage-forming substrate via a vibration plate, each of the piezoelectric elements including a lower electrode, a piezoelectric layer, and an upper electrode. The passage-forming substrate has a plurality of liquid supply paths that are equal in depth with the pressure generation chambers and communicate with corresponding longitudinal ends of the pressure generation chambers for supplying liquid to the pressure generation chambers. A reinforcement film is provided on the vibration plate in regions that face the liquid supply paths. The overall internal stress of the reinforcement film and the vibration plate is tensile.

9 Claims, 8 Drawing Sheets

LIQUID-JET HEAD AND LIQUID-JET APPARATUS

BACKGROUND OF THE INVENTION

1. Field of the Invention

The present invention relates to a liquid-jet head and a liquid-jet apparatus. More specifically, the present invention relates to ink-jet recording head configured such that an vibration plate partially constitutes a pressure generation chamber communicating with a nozzle orifice, through which a droplet of ink is ejected, and such that a piezoelectric element is provided via the vibration plate so as to eject a droplet of ink through displacing movement thereof, as well as to an ink-jet recording apparatus using the head.

2. Description of the Related Art

An ink-jet recording head is configured such that a vibration plate partially constitutes a pressure generation chamber communicating with a nozzle orifice, through which a droplet of ink is ejected, and such that a piezoelectric element causes the vibration plate to be deformed, thereby pressurizing ink contained in the pressure generation chamber and thus ejecting a droplet of ink through the nozzle orifice. Ink-jet recording heads which are put into practical use are classified into the following two types: an ink-jet recording head that employs a piezoelectric actuator operating in longitudinal vibration mode; i.e., expanding and contracting in the axial direction of a piezoelectric element; and an ink-jet recording head that employs a piezoelectric actuator operating in flexural vibration mode.

The former recording head has an advantage in that a function for changing the volume of a pressure generation chamber can be implemented through an end face of a piezoelectric element abutting a vibration plate, thereby exhibiting good suitability to high-density printing. However, the former recording head has a drawback in that a fabrication process is complicated; specifically, fabrication involves a difficult process of dividing the piezoelectric element into comb-tooth-like segments at intervals corresponding to those at which nozzle orifices are arranged, as well as a process of fixing the piezoelectric segments in such a manner as to be aligned with corresponding pressure generation chambers.

The latter recording head has an advantage in that piezoelectric elements can be formed on a vibration plate through a relatively simple process; specifically, a green sheet of piezoelectric material is overlaid on the vibration plate in such a manner as to correspond in shape and position to a pressure generation chamber, followed by firing. However, the latter recording head has a drawback in that a piezoelectric element must assume a certain amount of area in order to utilize flexural vibration, thus involving difficulty in arranging pressure generation chambers in high density.

In order to solve the drawback of the latter recording head, as disclosed in, for example, Japanese Patent Application Laid-Open (kokai) No. 1993-286131, the following process has been proposed. An even layer of piezoelectric material is formed on the entire surface of a vibration plate by use of a film deposition technique. By means of lithography the layer of piezoelectric material is divided in such a manner as to correspond in shape and position to pressure generation chambers, thereby forming independent piezoelectric elements corresponding to the pressure generation chambers.

In such an ink-jet recording head, ink supply paths are formed in a passage-forming substrate, in which pressure generation chambers are formed, such that each ink supply path communicates with a longitudinal end portion of the corresponding pressure generation chamber and is shallower than the pressure generation chamber. The ink supply paths regulate the flow resistance of ink flowing therethrough so as to supply ink to the individual pressure generation chambers at a constant flow rate.

Such ink supply paths are commonly formed by half-etching the passage-forming substrate. However, the depth of half-etching is difficult to control; as a result, the depth of ink supply paths varies among ink-jet recording heads. Since the flow resistance of ink flowing through individual ink supply paths varies among ink-jet recording heads, ink ejection characteristics are not stabilized among the ink-jet recording heads.

Note that the foregoing problems are not limited to ink-jet recording heads for ejecting ink, but are also applicable naturally to other liquid-jet heads for ejecting liquids other than ink.

SUMMARY OF THE INVENTION

In view of the foregoing, an object of the present invention is to provide a liquid-jet head having stabilized liquid ejection characteristics and enhanced reliability, as well as a liquid-jet apparatus using the head.

To achieve the above object, the present invention provides a liquid-jet head comprising a passage-forming substrate, a vibration plate, and a plurality of piezoelectric elements provided on one side of the passage-forming substrate via the vibration plate, wherein the passage-forming substrate has a plurality of pressure generation chambers formed therein in such a manner as to communicate with corresponding nozzle orifices, and each of the plurality of piezoelectric elements comprises a lower electrode, a piezoelectric layer, and an upper electrode. The passage-forming substrate has a plurality of liquid supply paths that are equal in depth with the pressure generation chambers and communicate with corresponding longitudinal ends of the pressure generation chambers for supplying liquid to the pressure generation chambers. A reinforcement film is provided on the vibration plate in regions that face the liquid supply paths. The overall internal stress of the reinforcement film and the vibration plate is tensile.

Through employment of the above features, the liquid supply paths can be formed with relatively high accuracy, thereby preventing variations, among liquid-jet heads, in the flow resistance of liquid flowing through individual liquid supply paths. Also, the reinforcement film enhances the rigidity of the vibration plate at portions located above the liquid supply paths, thereby preventing fracturing such as cracking of the vibration plate, which would otherwise arise during a fabrication process or result from driving of the piezoelectric elements.

The pressure generation chambers and the liquid supply paths may be formed in the passage-forming substrate while penetrating along the entire thickness of the passage-forming substrate. This arrangement facilitates the formation of the liquid supply paths with high accuracy.

The reinforcement film may comprise a nonactive piezoelectric portion of each of the piezoelectric elements. The nonactive piezoelectric portion includes the piezoelectric layer extending from an active piezoelectric portion, which substantially serves as a drive portion, of each of the piezoelectric elements, yet the nonactive piezoelectric portion substantially does not serve as a drive portion. This arrangement facilitates the formation of the reinforcement film and reliably prevents fracture of the vibration plate in regions that face the liquid supply paths.

The reinforcement film may comprise a discrete lower electrode film, which is the same film as used for the lower electrode and is separated from the lower electrode. This arrangement more reliably prevents fracture of the vibration plate in regions that face the liquid supply paths.

The reinforcement film may comprise a wiring electrode which extends from the upper electrode along to outside of the pressure generation chambers. This arrangement more reliably prevents fracture of the vibration plate in regions that face the liquid supply paths.

The reinforcement film may comprise a zirconium oxide layer. This arrangement more reliably prevents fracture of the vibration plate in regions that face the liquid supply paths.

The zirconium oxide layer may serve as part of the vibration plate. This arrangement facilitates the formation of the zirconium oxide layer and enhances the entire rigidity of the vibration plate, thereby more reliably preventing fracture of the vibration plate.

The pressure generation chambers and the liquid supply paths may be formed in a monocrystalline silicon substrate through anisotropic etching, and component layers of the piezoelectric elements are formed through film deposition and lithography. This arrangement facilitates the formation of the pressure generation chambers and the liquid supply paths at high accuracy and high density.

The present invention also provides an liquid-jet apparatus comprising a liquid-jet head as described above. The liquid-jet apparatus can provide stable liquid ejection characteristics of the head and enhanced reliability.

DESCRIPTION OF THE PREFERRED EMBODIMENTS

Embodiments of the present invention will next be described with reference to the drawings.

Figure 1:
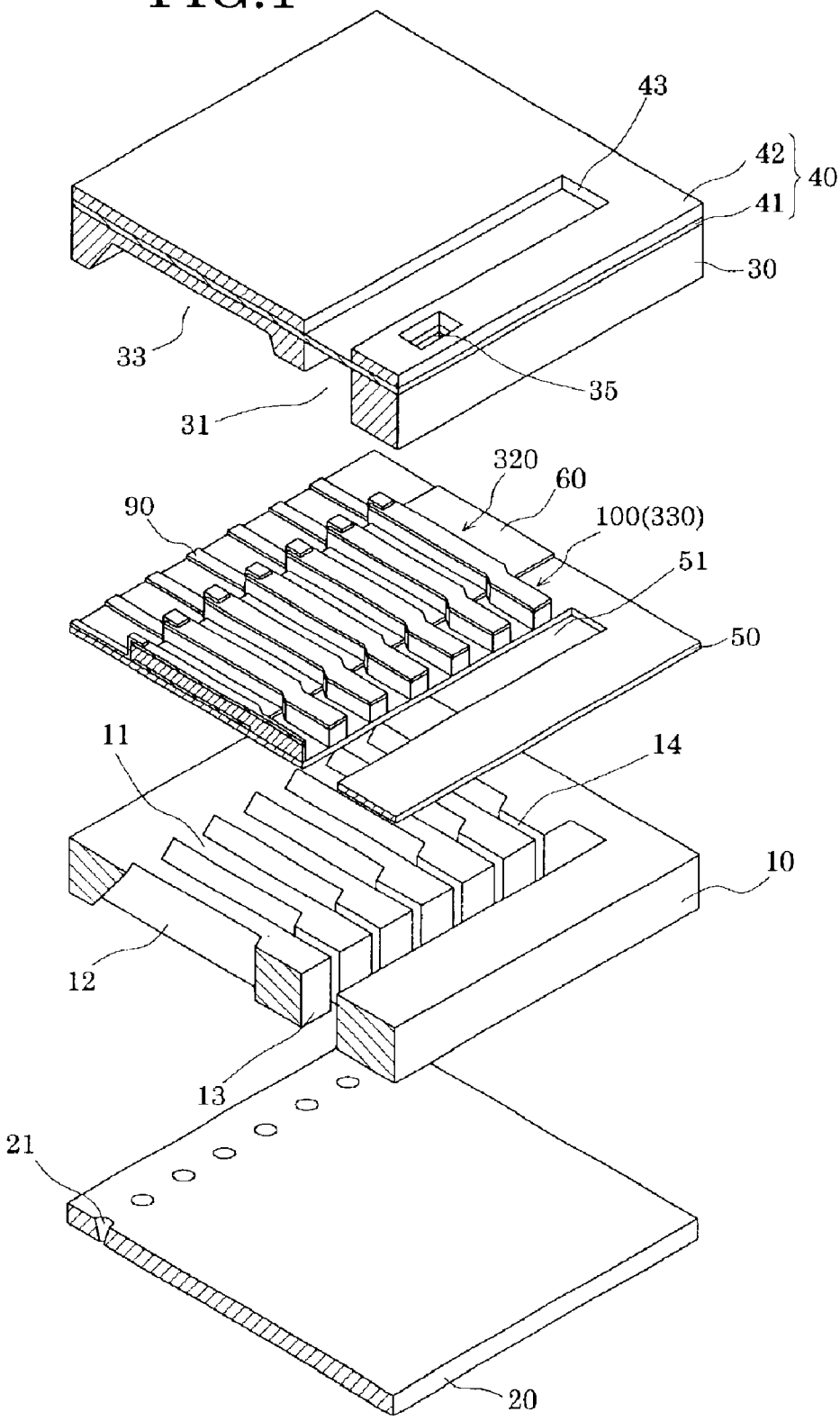
FIG. 1 is an exploded perspective view of an ink-jet recording head according to a first embodiment of the present invention.
Figure 2:
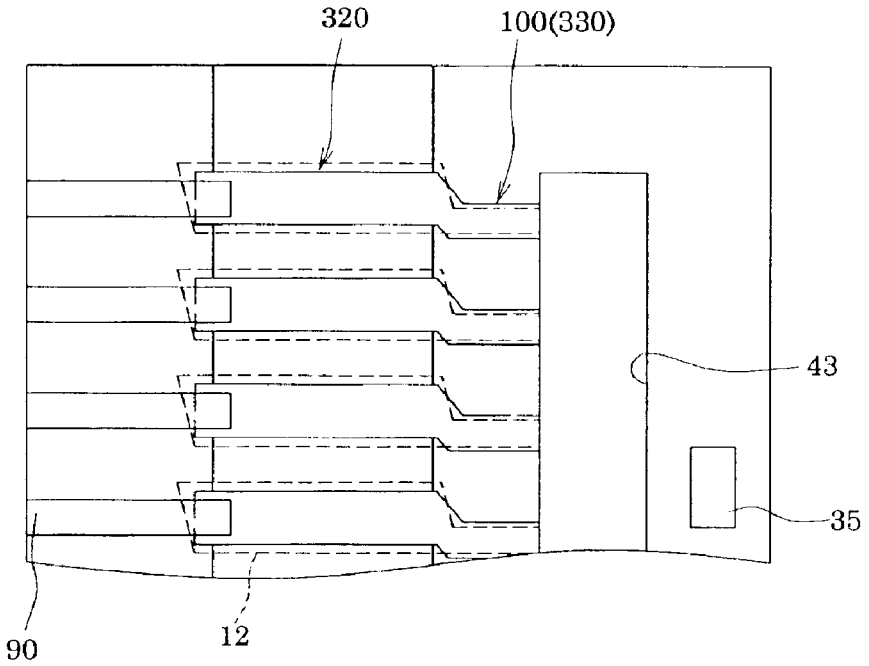
FIG. 2 is a plan view showing the structure of piezoelectric elements of the ink-jet recording head according to the first embodiment.
Figure 3:
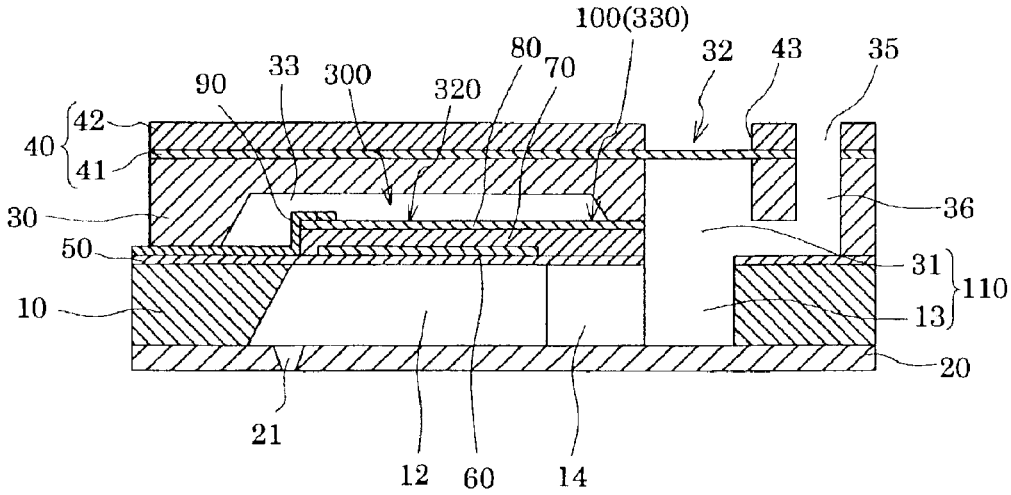
FIG. 3 is a sectional view of the ink-jet recording head according to the first embodiment.

First Embodiment:

FIGS. 1 to 3 show an ink-jet recording head according to a first embodiment of the present invention, as well as the structure of piezoelectric elements of the head.

A passage-forming substrate 10 is formed of a monocrystalline silicon substrate of (110) orientation. A plurality of pressure generation chambers 12 are formed in the passage-forming substrate 10 through anisotropic etching of the monocrystalline silicon substrate from one side (lower side) thereof, in such a manner that the pressure generation chambers 12 are separated from one another by means of a plurality of compartment walls 11 and are arranged along the width direction of a pressure generation chambers 12 at a density of about 180 pressure generation chambers 12 per inch (180 dpi). A communicating path 13 is formed in the passage-forming substrate 10 along the longitudinal end portions of the pressure generation chambers 12. The communicating path 13 communicates with a reservoir portion 31 of a reservoir plate 30, which will be described later, through a penetrated portion 51. The communicating path 13 partially constitutes a reservoir 110, which serves as a common ink chamber for the pressure generation chambers 12. The communicating path 13 communicates with the pressure generation chambers 12 at longitudinal end portions of the pressure generation chambers 12 via corresponding ink supply paths 14 being the liquid supply paths.

An elastic film 50 having a thickness of 1 $\mu$m to 2 $\mu$m and made of, for example, silicon dioxide ($SiO_2$) is formed on the other side (upper side) of the passage-forming substrate 10.

Anisotropic etching utilizes the following properties of a monocrystalline silicon substrate: when a monocrystalline silicon substrate is immersed in an alkaline solution, such as a KOH solution, the monocrystalline silicon substrate is gradually eroded such that there emerge the first (111) plane perpendicular to the (110) plane and the second (111) plane forming an angle of about 70 degrees with the first (111) plane and an angle of about 35 degrees with the (110) plane; and the (111) planes are etched at about 1/180 a rate at which the (110) planes are etched. Such anisotropic etching can precisely etch a recess having a cross-section of a parallelogram defined by two first (111) planes and two slant second (111) planes, whereby the pressure generation chambers 12 can be arranged at high density.

According to the present embodiment, the first (111) planes define the long sides of each pressure generation chamber 12, whereas the second (111) planes define the short sides of each pressure generation chamber 12. The pressure generation chambers 12 and the communicating path 13 are formed through etching the passage-forming substrate 10 along substantially the entire thickness until the elastic film 50 is reached. Notably, the elastic film 50 is little eroded by an alkaline solution used for etching the monocrystalline silicon substrate.

Further, in the present embodiment, the ink supply paths 14 communicating with the corresponding ends of the pressure generation chambers 12 are equal in depth with the pressure generation chambers 12; i.e., the ink supply paths 14 are formed in the passage-forming substrate 10 while penetrating along substantially the entire thickness of the passage-forming substrate 10. The ink supply paths 14 are narrower than the pressure generation chambers 12 and maintain the flow resistance of ink flowing into the pressure generation chambers 12 at a substantially constant level.

The width and length of the ink supply path 14 may be determined as appropriate in view of the volume of the pressure generation chamber 12 and the resistance of a nozzle orifice 21, among other factors. In the present embodiment, the passage-forming substrate 10 has a thickness of about 220 $\mu$m, and the pressure generation chambers 12 each have a width of about 65 $\mu$m and a length of about 1000 μm, whereas the ink supply paths 14 each have a width of about 20 μm and a length of about 150 μm.

In the present embodiment, the ink supply paths 14 are formed in the passage-forming substrate 10 while penetrating along substantially the entire thickness of the passage-forming substrate 10 and having a predetermined width, whereby the size of the ink supply paths 14 can be controlled with high accuracy through etching, thereby suppressing variations, among ink-jet recording heads, in the flow resistance of ink flowing therethrough. Therefore, variations in ink ejection characteristics among ink-jet recording heads can be suppressed.

Preferably, the optimum thickness is selected for the passage-forming substrate 10, in which the pressure generation chambers 12, the ink supply paths 14, etc. are formed, in relation to the density of arrangement of the pressure generation chambers 12. For example, when the pressure generation chambers 12 are to be arranged at about 180 dpi as in the case of the present embodiment, the thickness of the passage-forming substrate 10 is preferably about 180 μm to 280 μm, more preferably about 220 μm. When the pressure generation chambers 12 are to be arranged at relatively high density such as about 360 dpi, the thickness of the passage-forming substrate 10 is preferably not greater than 100 μm. Employment of such thickness allows high-density arrangement of the pressure generation chambers 12 while the rigidity of a compartment wall 11 between the adjacent pressure generation chambers 12 is maintained high. In this case, preferably, the ink supply paths 14 each have, for example, a width of about 26 μm and a length of about 250 μm.

A nozzle plate 20 is bonded, by use of adhesive, a thermally fusing film, or the like, to the lower side of the passage-forming substrate 10. Nozzle orifices 21 are formed in the nozzle plate 20 in such a manner that the nozzle orifices 21 communicate with the corresponding pressure generation chambers 12 at their ends opposite the ink supply paths 14. The nozzle plate 20 is formed from glass ceramic, stainless steel, or a like material having a thickness of, for example, 0.05 mm to 1 mm and a linear expansion coefficient of, for example, 2.5 to 4.5 ($\times 10^{-6}$/° C.) at temperature not higher than 300° C. The nozzle plate 20 covers the entire lower surface of the passage-forming substrate 10 where etching starts, thereby serving also as a reinforcement plate for protecting the monocrystalline silicon substrate from impact or an external force. The nozzle plate 20 may be formed from a material having a thermal expansion coefficient substantially identical with that of the passage-forming substrate 10. In this case, the passage-forming substrate 10 and the nozzle plate 20 are thermally deformed in substantially the same manner, whereby they can be readily bonded by use of thermosetting adhesive or the like.

A lower electrode film 60, a piezoelectric layer 70, and an upper electrode film 80 are formed, in layers by a process to be described later, on the elastic film 50 provided on the passage-forming substrate 10, thereby forming a piezoelectric element 300. The lower electrode film 60 assumes a thickness of, for example, about 0.2 μm; the piezoelectric layer 70 assumes a thickness of, for example, about 0.5 μm to 3 μm; and the upper electrode film 80 assumes a thickness of, for example, about 0.1 μm. Herein, the piezoelectric element 300 includes the lower electrode film 60, the piezoelectric layer 70, and the upper electrode film 80. Generally, either the lower electrode or the upper electrode assumes the form of a common electrode for use among the piezoelectric elements 300, whereas the other electrode and the piezoelectric layer 70 are formed, through patterning, for each of the pressure generation chambers 12. And, in this case, the portion that is constituted of any one of the electrodes and the piezoelectric layer 70, to which patterning is performed, and where piezoelectric distortion is generated by application of voltage to both electrodes, is referred to as a piezoelectric active portion 320. According to the present embodiment, the lower electrode film 60 serves as a common electrode for use among the piezoelectric elements 300, whereas the upper electrode film 80 serves as an individual electrode for use with a piezoelectric element 300. However, the configuration may be reversed in accordance with needs of a drive circuit and wiring. In either case, active piezoelectric portions are formed for individual pressure generation chambers. In the present embodiment, a piezoelectric element 300 and a vibration plate, which is deformed as a result of the piezoelectric element 300 driving, are collectively referred to as a piezoelectric actuator. The elastic film 50 and the lower electrode film 60 serve as a vibration plate.

In addition, the upper electrode films 80 are connected to unillustrated corresponding external wiring lines via corresponding lead electrodes 90, which extend onto the elastic film 50 from corresponding end portions of the upper electrode films 80 opposite the ink supply paths 14.

Further, reinforcement films 100, each being wider than the ink supply path 14, are provided on the elastic film 50 in regions that face the ink supply paths 14. The overall internal stress of the reinforcement film 100 and the elastic film 50 is tensile. For example, the reinforcement film 100 of the present embodiment is formed of a film used for forming the piezoelectric element 300, whereby the overall internal stress is tensile.

Specifically, each of the piezoelectric elements 300 includes the active piezoelectric portion 320, which is located in a region facing the pressure generation chamber 12 and substantially serves as a drive portion, and a nonactive piezoelectric portion 330, which includes the piezoelectric layer 70 extending from the active piezoelectric portion 320, yet substantially does not serve as a drive portion. The nonactive piezoelectric portion 330 serves as the reinforcement film 100. For example, in the present embodiment, the lower electrode film 60 is patterned in such a manner as not to extend into a region facing the ink supply path 14, whereas the piezoelectric layer 70 and the upper electrode film 80 extend from a region facing the pressure generation chamber 12 to the region facing the ink supply path 14 to thereby form the reinforcement film 100 (the nonactive piezoelectric portion 330).

As described above, in the present embodiment, the reinforcement films 100 are provided in regions that face the ink supply paths 14, and the overall internal stress of the reinforcement film 100 and the elastic film 50 is tensile, thereby preventing fracture of the elastic film 50 in the regions facing the ink supply paths 14 which would otherwise occur during a fabrication process or result from driving of the piezoelectric elements 300. Therefore, the flow resistance of ink flowing through the ink supply paths 14 can be controlled with high accuracy, and ink-jet recording heads having stable ink ejection characteristics can be mass-produced with relative ease.

Since the overall internal stress of the reinforcement film 100 and the elastic film 50 is tensile, internal stress in the reinforcement film 100 and that in the elastic film 50 do not cause fracturing such as cracking of the elastic film 50. By contrast, if the overall internal stress of the reinforcement film 100 and the elastic film 50 is compressive, internal stress in the reinforcement film 100 and that in the elastic film 50 may cause buckling of the elastic film 50, resulting in fracturing such as cracking of the elastic film 50.

Figure 4:
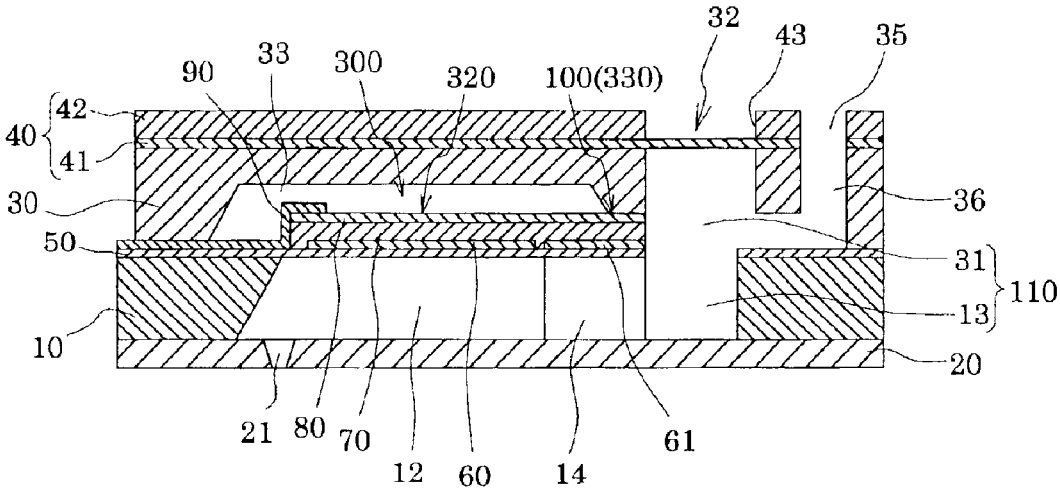
FIG. 4 is a sectional view showing an ink-jet recording head according to a modification of the first embodiment.

The present embodiment has been described including the reinforcement film 100 composed of the piezoelectric layer 70 and the upper electrode film 80. However, the present invention is not limited thereto. For example, as shown in FIG. 4, a discrete lower electrode film 61 is formed in a region facing the ink supply path 14 in separation from the lower electrode film 60 which partially constitutes the active piezoelectric portion 320, such that the reinforcement film 100 includes the discrete lower electrode film 61 as well as the piezoelectric layer 70 and the upper electrode film 80. In any case, no particular limitation is imposed on the structure of the reinforcement film 100, so long as the reinforcement film 100 includes the nonactive piezoelectric portion 330, and the overall internal stress of the reinforcement film 100 and the elastic film 50 is tensile.

Next, a process for forming the piezoelectric elements 300 and other components on the passage-forming substrate 10 made of a monocrystalline silicon substrate will be described with reference to FIGS. 5 and 6.

Figure 5A:
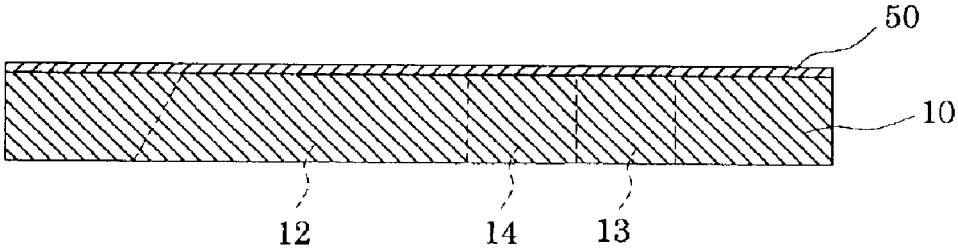
FIGS. 5A to 5D are sectional views showing a process for fabricating the ink-jet recording head of the first embodiment.

As shown in FIG. 5A, a monocrystalline silicon wafer, from which the passage-forming substrates 10 are formed, is thermally oxidized at about 1100° C. in a diffusion furnace, thereby forming the elastic film 50 of silicon dioxide thereon.

Figure 5B:
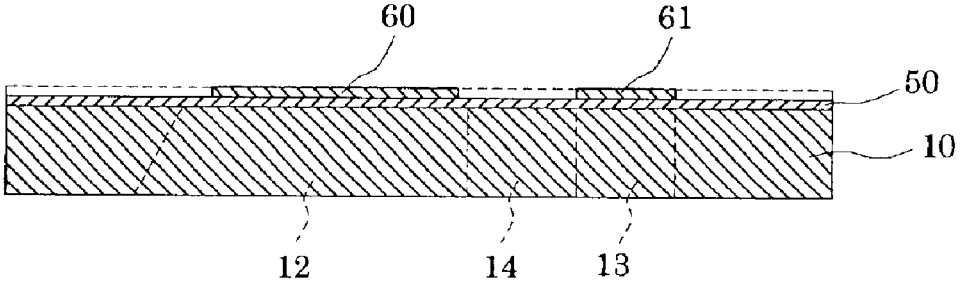

Next, as shown in FIG. 5B, an electrode film is deposited on the entire surface of the elastic film 50 through sputtering and is patterned into the lower electrode film 60 and the discrete lower electrode film 61. Notably, in the present embodiment, the discrete lower electrode film 61 separated from the lower electrode film 60, which partially constitutes each piezoelectric element 300, is left in a region where the communicating path 13 is to be formed.

Platinum (Pt) is a preferred material for the lower electrode film 60 for the following reason: the piezoelectric layer 70 to be deposited by a sputtering process or a sol-gel process must be crystallized, after deposition, through firing at a temperature of about 600° C. to 1000° C. in the atmosphere or an oxygen atmosphere. That is, material for the lower electrode film 60 must maintain electrical conductivity in such a high-temperature oxidizing atmosphere. Particularly, when lead zirconate titanate (PZT) serves as the piezoelectric layer 70, the material is desirably tiny in variation of electrical conductivity to be caused by diffusion of lead oxide (PbO). Thus, platinum is preferred.

Figure 5C:
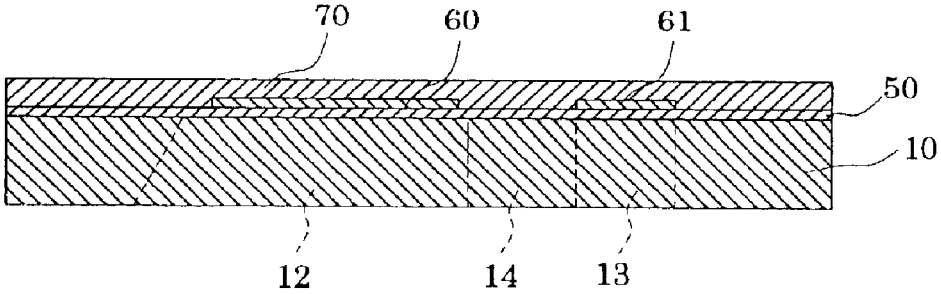

Next, as shown in FIG. 5C, the piezoelectric layer 70 is deposited. Sputtering may be employed for depositing the piezoelectric layer 70; however, the present embodiment employs a sol-gel process. Specifically, an organic substance of metal is dissolved and dispersed in a solvent to obtain a so-called sol. The sol is applied and dried to obtain gel. The gel is subjected to firing at high temperature, thereby yielding the piezoelectric layer 70 made of a metallic oxide. In application to an ink-jet recording head, a lead zirconate titanate (PZT) material is a preferred material for the piezoelectric layer 70.

Alternatively, a precursor of lead zirconate titanate is formed by a sol-gel process or a sputtering process and is then caused to undergo crystal growth in an alkaline aqueous solution at low temperature by use of a high-pressure treatment process.

In contrast to a bulk piezoelectric material, the thus-deposited piezoelectric layer 70 assumes crystallographically preferred orientation. Further, in the piezoelectric layer 70 of the present embodiment, crystals assume a columnar, rhombohedral form. Notably, preferred orientation refers to a state in which crystals are orderly oriented; i.e., certain crystal planes face the same direction. A thin film of columnar crystals refers to a state in which substantially cylindrical crystals are collected along the planar direction while axes thereof extend substantially along the thickness direction thereof, to thereby form a thin film. Of course, a thin film may be formed of granular crystals of preferred orientation. A piezoelectric layer deposited by such a thin film deposition process generally assumes a thickness of 0.2 $\mu$m to 5 $\mu$m.

Figure 5D:
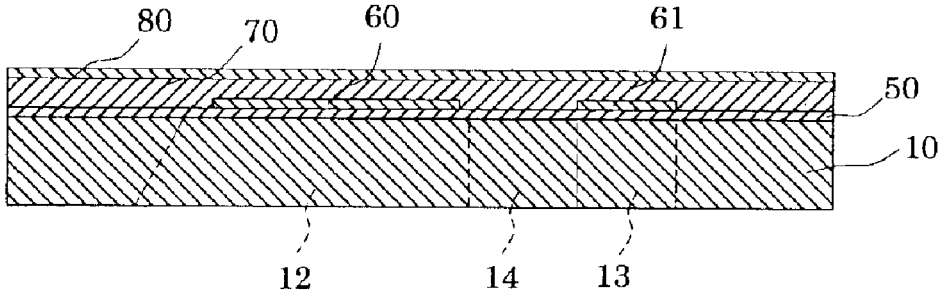

Next, as shown in FIG. 5D, the upper electrode film 80 is formed. The upper electrode film 80 may be made of any material of high electrical conductivity, such as aluminum, gold, nickel, platinum, or a like metal, or an electrically conductive oxide. According to the present embodiment, platinum is deposited through sputtering.

Figure 6A:
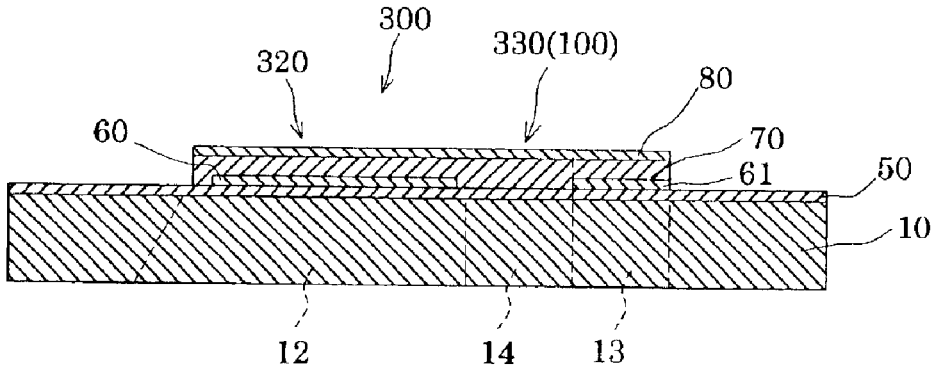
FIGS. 6A to 6C are sectional views showing a process subsequent to the process of the first embodiment.

Next, as shown in FIG. 6A, the piezoelectric layer 70 and the upper electrode film 80 are etched to form the piezoelectric elements 300 arranged in a predetermined pattern. That is, the active piezoelectric portions 320 are formed in regions that face the pressure generation chambers 12, and the nonactive piezoelectric portions 330 (reinforcement films 100) are formed in regions that face the ink supply paths 14. In the present embodiment, the piezoelectric layer 70 and the upper electrode film 80 are formed in such a manner as to extend onto the discrete lower electrode film 61.

Figure 6B:
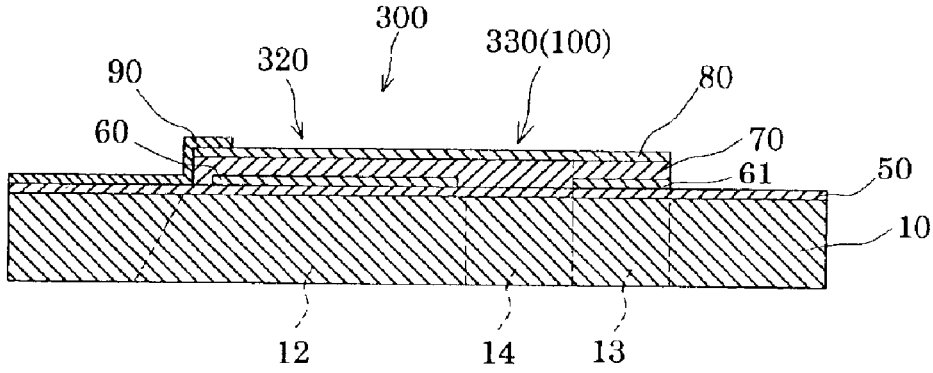

Next, as shown in FIG. 6B, lead electrodes 90 are formed. Specifically, the lead electrode 90 made of, for example, gold (Au) is formed on the passage-forming substrate 10 along the entire films on the substrate 10 and then undergoes patterning to thereby be divided into the individual lead electrodes 90 corresponding to the piezoelectric elements 300.

Figure 6C:
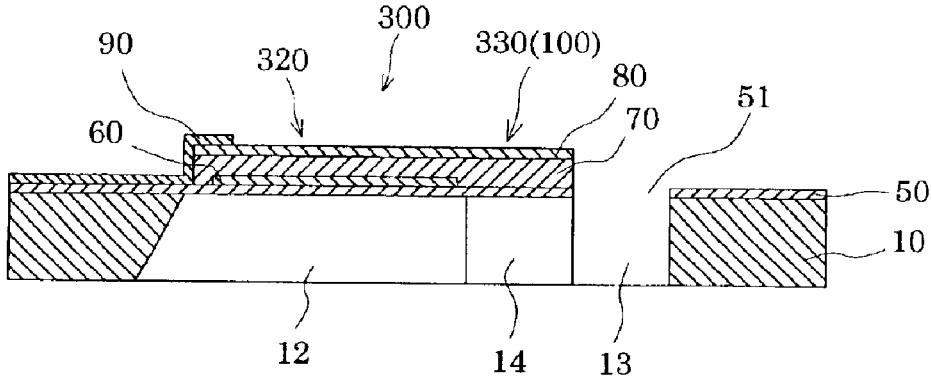

After the above-described film deposition process, as described previously, the monocrystalline silicon substrate is anisotropically etched by use of an alkaline solution, whereby, as shown in FIG. 6C, the pressure generation chambers 12, the communicating path 13, and the ink supply paths 14 are formed simultaneously. Also, those portions of the elastic film 50, discrete lower electrode films 61, piezoelectric layers 70, and upper electrode films 80 which are present in the region that faces the communicating path 13 are etched out, thereby forming the penetrated portion 51.

In actuality, a number of chips are simultaneously formed on a single wafer by a series of film deposition processes and a subsequent anisotropic etching process. The thus-formed wafer is divided into chip-sized passage-forming substrates 10, as shown in FIG. 1. The reservoir plate 30 and a compliance plate 40, which will be described later, are sequentially bonded to each of the passage-forming substrates 10. The resultant unit becomes an ink-jet recording head.

As shown in FIGS. 1 and 2, the reservoir plate 30 including the reservoir portion 31, which partially constitutes the reservoir 110, is bonded to the upper side of the passage-forming substrate 10 including the pressure generation chambers 12. In the present embodiment, the reservoir portion 31 is formed in the reservoir plate 30 in such a manner as to penetrate through the reservoir plate 30 in the thickness direction of the plate 30 while penetrating along the width direction of the pressure generation chambers 12. The reservoir portion 31 communicates with the communicating path 13 of the passage-forming substrate 10 via the penetrated portion 51, which penetrates through the elastic film 50 and the lower electrode film 60 in the thickness direction of the films 50 and 60, thereby forming the reservoir 110, which serves as a common ink chamber for use among the pressure generation chambers 12.

Preferably, the reservoir plate 30 is made of a material having a thermal expansion coefficient substantially equal to that of the passage-forming substrate 10; for example, glass or a ceramic material. In the present embodiment, the reservoir plate 30 and the passage-forming substrate 10 are formed of the same material; i.e., a monocrystalline silicon substrate. Thus, as in the case of bonding of the nozzle plate 20 and the passage-forming substrate 10, even when the reservoir plate 30 and the passage-forming substrate 10 are bonded at high temperature by use of a thermosetting adhesive, they can be bonded reliably. Thus, a fabrication process can be simplified.

Further, the compliance plate 40, which includes a sealing film 41 and a fixture plate 42, is bonded to the reservoir plate 30. The sealing film 41 is formed of a low-rigidity material having flexibility (e.g., polyphenylene sulfide (PPS) film having a thickness of 6 $\mu$m). The sealing film 41 seals one side of the reservoir portion 31. The fixture plate 42 is formed of a hard material, such as metal, (e.g., a stainless steel (SUS) plate having a thickness of 30 $\mu$m). A region of the fixture plate 42 that faces the reservoir 110 is completely removed in the thickness direction of the fixture plate 42 to thereby form an opening 43. As a result, one side of the reservoir 110 is covered merely with the flexible sealing film 41 to thereby form a flexible portion 32, which is deformable according to a change in the inner pressure of the reservoir 110.

An ink inlet 35, through which ink is supplied to the reservoir 110, is formed in the compliance plate 40 and is located at a substantially central portion with respect to the longitudinal direction of the reservoir 110 and outside the reservoir 110 with respect to the lateral direction of the reservoir 110. Further, an ink introduction channel 36 for establishing communication between the ink inlet 35 and the reservoir 110 is formed in the reservoir plate 30 while penetrating through the sidewall of the reservoir 110.

A piezoelectric element accommodation portion 33 is formed in a region of the reservoir plate 30 which faces the piezoelectric elements 300, in such a manner as to provide a space, in a sealed condition, for allowing free movement of the piezoelectric elements 300. At least the active piezoelectric portions 320 of the piezoelectric elements 300 are sealed in the piezoelectric element accommodation portion 33, whereby the piezoelectric elements 300 are protected from fracture which would otherwise result from environmental causes, such as water in the atmosphere.

The thus-configured ink-jet recording head operates in the following manner. Unillustrated external ink supply means is connected to the ink inlet 35 and supplies ink to the ink-jet recording head through the ink inlet 35. The thus-supplied ink fills an internal space extending from the reservoir 110 to the nozzle orifices 21. In accordance with a record signal from an unillustrated external drive circuit, voltage is applied between an upper electrode film 80 and the lower electrode film 60, thereby causing the elastic film 50, the lower electrode film 60, and the piezoelectric layer 70 to be deformed. As a result, pressure within a corresponding pressure generation chamber 12 increases to thereby eject a droplet of ink from a corresponding nozzle orifice 21.

Second Embodiment

Figure 7A:
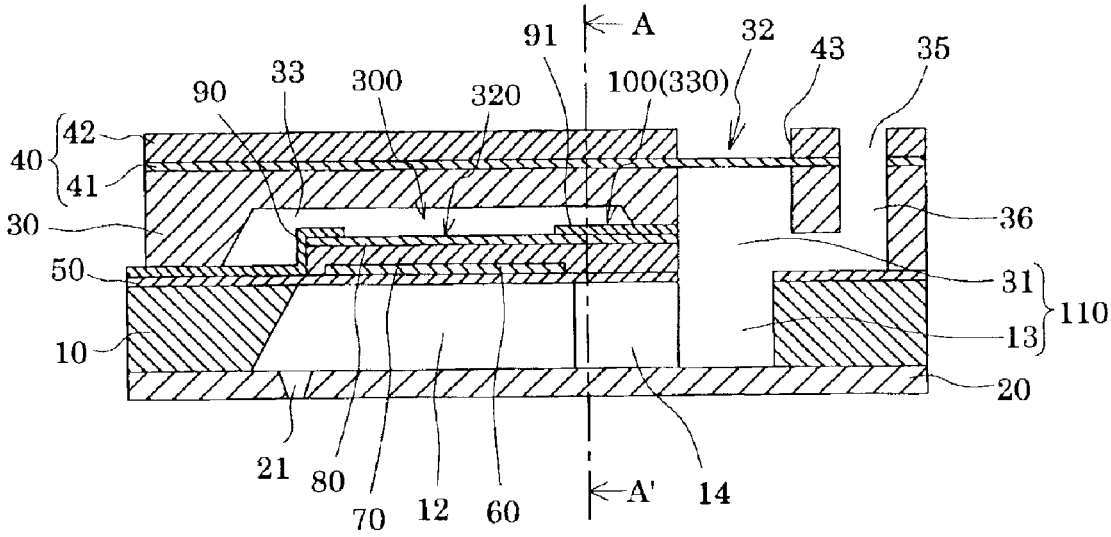
FIGS. 7A and 7B are sectional views showing an ink-jet recording head according to a second embodiment of the present invention.
Figure 7B:
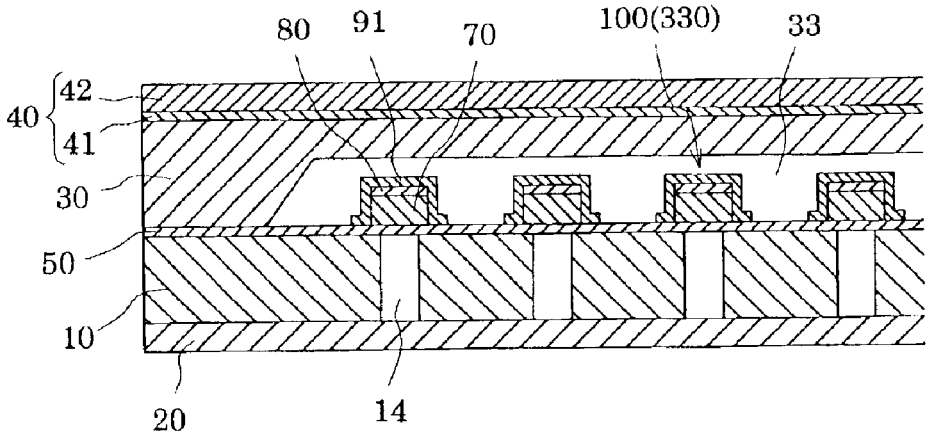

FIGS. 7A and 7B show an ink-jet recording head according to a second embodiment of the present invention.

As shown in FIGS. 7A and 7B, the present embodiment is configured such that the reinforcement film 100 includes a wiring electrode layer 91, which is formed of the same layer as that used for forming the lead electrode 90. The present embodiment is similar to the first embodiment except that, in the course of patterning the lead electrodes 90, the wiring electrode layer 91 is left to cover the nonactive piezoelectric portions 330. Also, when the reinforcement film 100 includes the wiring electrode layer 91 as in the case of the present embodiment, the overall internal stress of the elastic film 50 and the reinforcement film 100 is tensile.

Employment of the reinforcement film 100 that includes the nonactive piezoelectric portion 330 and the wiring electrode layer 91 further enhances the rigidity of those portions of the elastic film 50 located in the regions that face the ink supply paths 14, thereby reliably preventing occurrence of fracture such as cracking in the elastic film 50, for example, at the time of driving of the piezoelectric elements 300.

In the present embodiment, the upper electrode films 80 are connected to unillustrated corresponding external wiring lines via the corresponding lead electrodes 90, which extend onto the elastic film 50 from corresponding end portions of the upper electrode films 80 opposite the ink supply paths 14. However, the upper electrode films 80 may be connected to the corresponding external wiring lines via the corresponding wiring electrode layers 91 that cover the corresponding nonactive piezoelectric portions 330.

Other Embodiments:

While the present invention has been described with reference to the embodiments, the present invention is not limited thereto.

Figure 8:
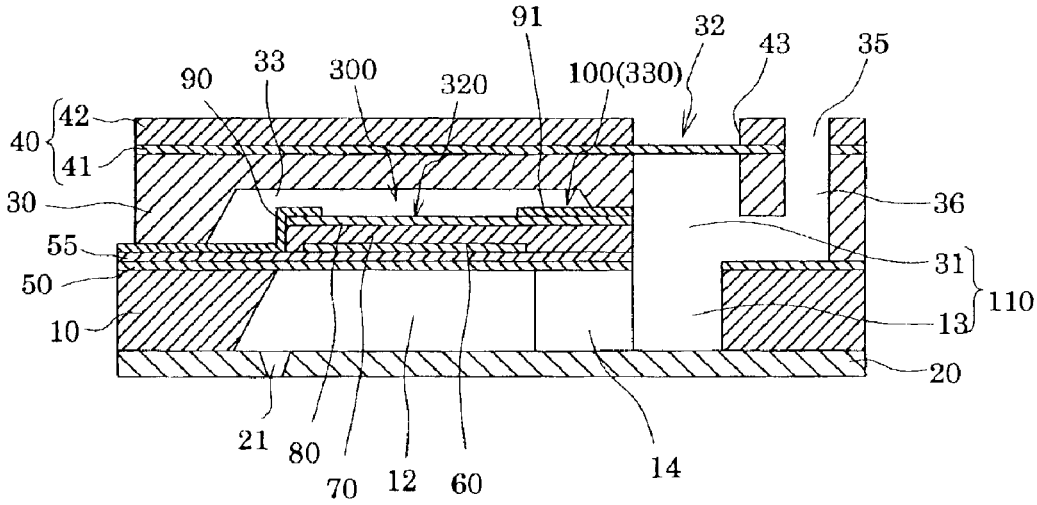
FIG. 8 is a sectional view showing an ink-jet recording head according to another embodiment of the present invention.

For example, in the above-described embodiments, the piezoelectric elements 300 are formed on the elastic film 50 formed from silicon oxide. However, as shown in FIG. 8, a second elastic film 55 of, for example, zirconium oxide ($ZrO_2$) may be formed on the entire surface of the elastic film 50, so that the piezoelectric elements 300 are formed on the second elastic film 55. Of course the second elastic film 55 may be provided merely in the region which faces the ink supply paths 14.

Employment of the second elastic film 55 further enhances the rigidity of those portions of the elastic film 50 which face the ink supply paths 14, thereby preventing occurrence of fracture such as cracking in the elastic film 50, for example, at the time of driving of the piezoelectric elements 300.

Also, the above embodiments are described including the reinforcement film 100 which includes the nonactive piezoelectric portion 330. However, the reinforcement film may include a layer different from the piezoelectric element 300. No particular limitation is imposed on the structure of the reinforcement film so long as the reinforcement film covers those regions which face the ink supply paths, and the overall internal stress of the elastic film and the reinforcement film is tensile.

Further, the above embodiments are described including the pressure generation chambers 12 and the ink supply paths 14 which are formed in the passage-forming substrate 10 while penetrating therethrough along the thickness direction of the substrate 10. However, the pressure generation chambers and the ink supply paths do not necessarily need to penetrate the entire thickness of the passage-forming substrate, so long as the ink supply paths and the pressure generation chambers assume the same depth. Impartment of the same depth to the ink supply paths and the pressure generation chambers allows control of the flow resistance of ink flowing through the ink supply paths with relatively high accuracy.

Also, the above embodiments are described including a thin-film-type ink-jet recording head, whose fabrication employs a film deposition process and a lithography process.

However, the present invention is not limited thereto. The present invention may be applicable to ink-jet recording heads of various structures, such as an ink-jet recording head which employs a piezoelectric layer formed by affixing or screen-printing a green sheet and an ink-jet recording head which employs a piezoelectric layer formed through crystal growth effected by a hydrothermal process.

The present invention may be applicable to ink-jet recording heads of various structures without departing from the spirit or scope of the invention.

Figure 9:
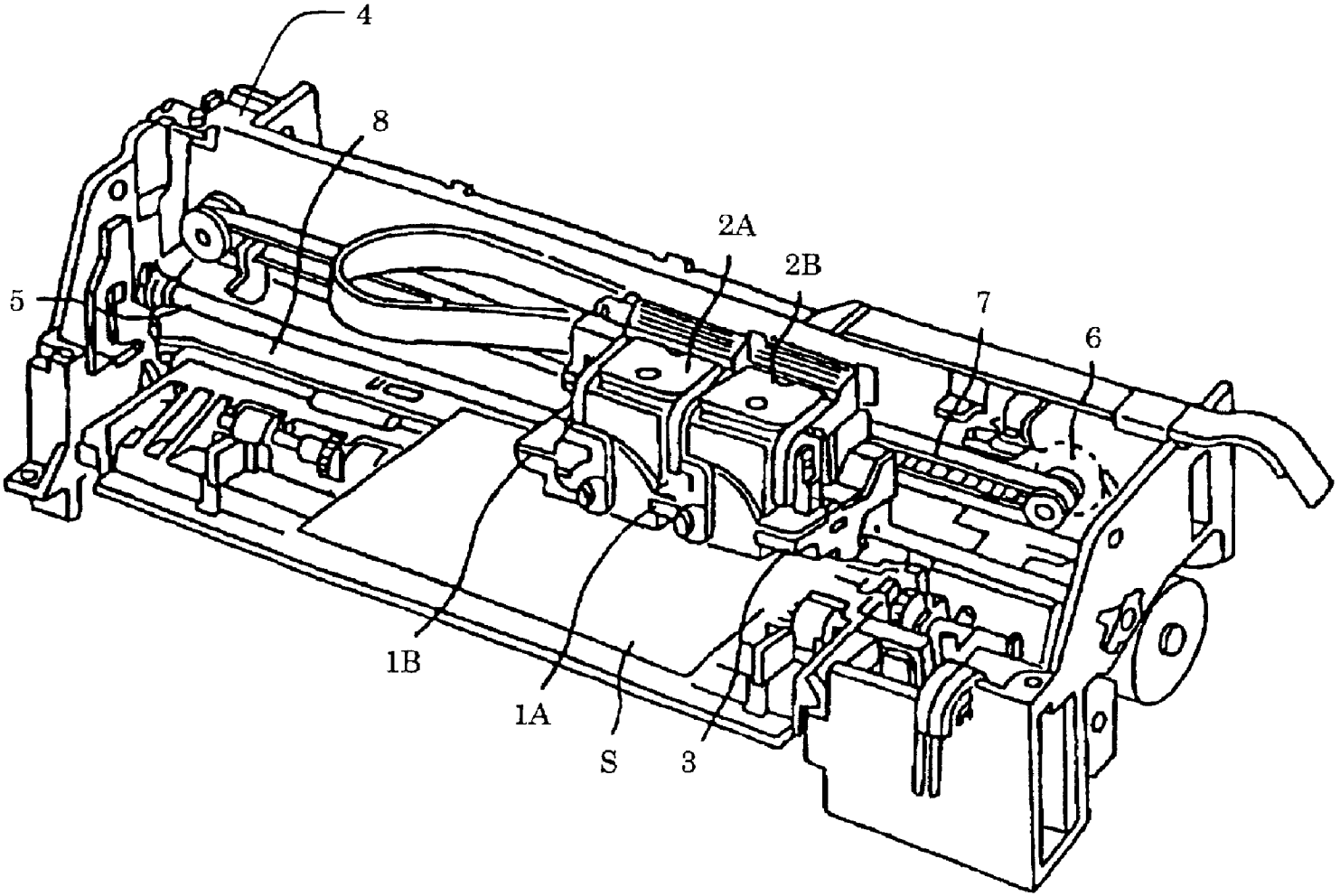
FIG. 9 is a schematic view of an ink-jet recording apparatus which includes an ink-jet recording head according to the present invention.

The ink-jet-recording heads of the embodiments as described above partially constitutes a recording head unit including an ink channel communicating with an ink cartridge or a like device to thereby be mounted on an ink-jet recording apparatus. FIG. 9 schematically shows an embodiment of such an ink-jet recording apparatus.

As shown in FIG. 9, recording head units 1A and 1B each including an ink-jet recording head removably carry cartridges 2A and 2B, respectively, serving as ink supply means. A carriage 3 that carries the recording head units 1A and 1B is axially movably mounted on a carriage shaft 5, which is attached to an apparatus body 4. The recording head units 1A and 1B are adapted to eject, for example, a black ink composition and a color ink composition, respectively.

Driving force of a drive motor 6 is transmitted to the carriage 3 via a plurality of unillustrated gears and a timing belt 7, whereby the carriage 3, which carries the recording head units 1A and 1B, moves along the carriage shaft 5. A platen 8 is provided on the apparatus body 4 in such a manner as to extend along the path of the carriage 3. The platen 8 is rotated by means of driving force of an unillustrated paper feed motor, whereby a recording sheet S, which is a recording medium, such as paper fed by means of paper feed rollers, is conveyed onto the same.

In the foregoing explanations, the ink-jet recording head for ejecting ink has been taken as an example of the liquid-jet head. However, it is to be understood that the present invention is generally applicable to wide ranges of liquid-jet heads and liquid-jet apparatuses.

Such applied liquid-jet heads may include, for example, a recording head for use in an image recording apparatus such as a printer, a color material-jet head for use in fabrication of a color filter of a liquid crystal display device and the like, an electrode material-jet head for use in formation of electrodes of an organic electroluminescent display device, a field emission display (FED) device and the like, and a bioorganic material-jet head for use in fabrication of a biochip.

As described above, in the present invention, liquid supply paths that are equal in depth with the pressure generation chambers are formed in the passage-forming substrate. Therefore, the liquid supply paths can be formed with relatively high accuracy, thereby preventing variations in flow resistance among liquid-jet heads, in particular when the pressure generation chambers and the liquid supply paths are formed in the passage-forming substrate to penetrate the passage-forming substrate. Thus, the present invention facilitates the mass production of liquid-jet heads having stable liquid ejection characteristics.

Moreover, a reinforcement film is provided on the vibration plate in regions that face the liquid supply paths, and the overall internal stress of the reinforcement film and the vibration plate is tensile. Therefore, it is possible to prevent fracturing such as cracking of the vibration plate in regions facing the liquid supply paths, which fracturing would otherwise occur during a fabrication process or result from driving of the piezoelectric elements.

What is claimed is:

1. A liquid-jet head comprising:

a passage-forming substrate having a plurality of pressure generation chambers communicating with corresponding nozzle orifices; and a plurality of piezoelectric elements provided on one side of said passage-forming substrate via a vibration plate, each of said piezoelectric elements comprising a lower electrode, a piezoelectric layer, and an upper electrode, said passage-forming substrate having a plurality of liquid supply paths that are equal in depth with said pressure generation chambers and communicate with corresponding longitudinal ends of said pressure generation chambers for supplying liquid to said pressure generation chambers, an active piezoelectric section, which substantially serves as a drive section of each of said piezoelectric elements, provided in a region facing a corresponding one of said pressure generation chambers, such that an end of said active piezoelectric section, on a side toward said liquid supply paths, is within said region facing the corresponding one of said pressure generation chambers, a reinforcement film being provided on said vibration plate in regions that face said liquid supply paths, said reinforcement film comprising a nonactive piezoelectric section of each of said piezoelectric elements in regions that face said liquid supply paths, the nonactive piezoelectric section including said piezoelectric layer which extends from said active piezoelectric section but remaining substantially undriven, and an overall internal stress of said reinforcement film and said vibration plate being tensile.

2. A liquid-jet head according to claim 1, wherein said pressure generation chambers and said liquid supply paths are formed in said passage-forming substrate while penetrating along the entire thickness of said passage-forming substrate.

3. A liquid-jet head according to claim 1, wherein said reinforcement film comprises a discrete lower electrode film, which is the same film as used for said lower electrode and is separated from said lower electrode.

4. A liquid-jet head according to claim 1, further comprising a wiring electrode which extends from said upper electrode along to outside of said pressure generation chambers.

5. A liquid-jet head according to claim 1, wherein said reinforcement film comprises a zirconium oxide layer.

6. A liquid-jet head according to claim 5, wherein said zirconium oxide layer serves as part of said vibration plate.

7. A liquid-jet head according to claim 1, wherein said pressure generation chambers and said liquid supply paths are formed in a monocrystalline silicon substrate through anisotropic etching, and component layers of said piezoelectric elements are formed through film deposition and lithography.

8. A liquid-jet apparatus comprising a liquid-jet head according to any one of claims 1, 2, 4 and 7.

9. A liquid-jet head comprising:

a passage-forming substrate having a plurality of pressure generation chambers communicating with corresponding nozzle orifices; and a plurality of piezoelectric elements provided on one side of said passage-forming substrate via a vibration plate, each of said piezoelectric elements comprising a lower electrode, a piezoelectric layer, and an upper electrode, said passage-forming substrate having a plurality of liquid supply paths that are equal in depth with said pressure generation chambers and communicate with corresponding longitudinal ends of said pressure generation chambers for supplying liquid to said pressure generation chambers, an active piezoelectric section, which substantially serves as a drive section of each of said piezoelectric elements, provided in a region facing a corresponding one of said pressure generation chambers, such that an end of said active piezoelectric section, on a side toward said liquid supply paths, is within said region facing the corresponding one of said pressure generation chambers, a reinforcement film being provided on said vibration plate in regions that face said liquid supply paths, said reinforcement film comprising a nonactive piezoelectric section of each of said piezoelectric elements in regions that face said liquid supply paths, the nonactive piezoelectric section including said piezoelectric layer but remaining substantially undriven, and an overall internal stress of said reinforcement film and said vibration plate being tensile.

* * * * *